US006789911B2

(12) United States Patent
Nelson et al.

(10) Patent No.: US 6,789,911 B2
(45) **Date of Patent: *Sep. 14, 2004**

(54) DECORATIVE STRUCTURE HAVING DISPERSED CHEMICAL ILLUMINATION SOURCES

(76) Inventors: Webb Nelson, 19180 144th Ave. NE., Woodinville, WA (US) 98072; Mark Chernick, 19180 144th Ave. NE., Woodinville, WA (US) 98072

( * ) Notice: Subject to any disclaimer, the term of this patent is extended or adjusted under 35 U.S.C. 154(b) by 8 days.

This patent is subject to a terminal disclaimer.

(21) Appl. No.: 10/053,937

(22) Filed: Jan. 24, 2002

(65) Prior Publication Data

US 2003/0021102 A1 Jan. 30, 2003

Related U.S. Application Data

(63) Continuation-in-part of application No. 09/912,659, filed on Jul. 25, 2001.

(51) Int. Cl.[7] ..... F21V 21/30

(52) U.S. Cl. ..... 362/35; 362/34; 362/96; 362/269; 446/217; 446/219

(58) Field of Search ..... 362/35, 34, 96, 362/102, 109, 269, 270, 253; 446/217, 218, 219, 48

(56) References Cited

U.S. PATENT DOCUMENTS

| | | | | | |
|---|---|---|---|---|---|
| 1,910,923 | A | * | 5/1933 | Kerr | 446/218 |
| 2,923,088 | A | * | 2/1960 | Peretti | 446/217 |
| 3,475,850 | A | * | 11/1969 | Lee | 446/217 |
| 3,974,369 | A | * | 8/1976 | Chmela et al. | 362/190 |
| 4,582,497 | A | * | 4/1986 | Lyons | 446/217 |
| 4,767,373 | A | * | 8/1988 | Antonio | 446/217 |
| 5,092,809 | A | * | 3/1992 | Kessler | 446/217 |
| 6,036,331 | A | * | 3/2000 | Acquisto | 362/96 |
| 6,367,942 | B1 | * | 4/2002 | Bauer | 362/35 |
| 6,394,752 | B1 | * | 5/2002 | Lai | 416/5 |
| 6,575,585 | B2 | * | 6/2003 | Nelson et al. | 362/35 |

* cited by examiner

*Primary Examiner*—John Anthony Ward
(74) *Attorney, Agent, or Firm*—LaMorte & Associates

(57) ABSTRACT

An illuminated assembly that can be configured as a pinwheel, pinwheel bow or decorative bow. The illuminated assembly includes segments of material that are folded over to form looped structures. At least some of the looped structures retain chemical light assemblies that are used to illuminate the folded loop structures when activated.

18 Claims, 4 Drawing Sheets

DECORATIVE STRUCTURE HAVING DISPERSED CHEMICAL ILLUMINATION SOURCES

RELATED APPLICATIONS

This application is a continuation-in-part of U.S. patent application Ser. No. 09/912,659, filed Jul. 25, 2001 and entitled Decorative Structure Having Dispersed Sources Of Illumination.

BACKGROUND OF THE INVENTION

1. Field of the Invention

The present invention relates to decorative structures that are illuminated with multiple light sources. More particularly, the present invention relates to decorative structures, such as pinwheels, bows and folded ribbons that are illuminated using multiple light sources.

2. Prior Art Statement

Traditional decorative bows are typically made from looped strips of paper or fabric that are folded in a symmetrical pattern. Decorative bows are commonly used as decorations on packages. Such bows are also used as Christmas tree decorations, door decorations, wall hangings and the like. A variation of the folded bow is the pinwheel. In a pinwheel, material is folded and looped to form vanes instead of decorative loops. The center of each folded vane is then attached to an axle pin. This enables the folded vanes of the pinwheel to turn as the vanes of the pinwheel catch the wind. Pinwheels, like traditional bows, are also used to adorn packages and form decorative objects.

Typically, the aesthetic value of a bow or pinwheel relies greatly on the material used to form that object and the complexity of the folds used in its creation. For this reason, bows and pinwheels are often made from brightly colored and/or decorated materials. In an attempt to make bows and pinwheels even more noticeable, illumination sources have been added to bows and pinwheels. The illumination sources illuminate the folds of the bow or pinwheel, thereby making the structure more noticeable, especially in low light conditions.

Traditional decorative bows are stationary objects. As such, illuminating a traditional bow is not a complex endeavor. Illumination sources are placed into the bow. If multiple illumination sources are used, the various illumination sources are connected in series with wire. The wire is then hidden within the folds of the bow. The problems associated with illuminating a bow is that room must be made in or around the bow to hold the batteries for the lights. Furthermore, the cost of the batteries and illumination sources typically cost much more than does the bow itself. An example of an illuminated bow is shown in U.S. Pat. No. 6,174,072 to Root, Jr., entitled Illuminated Ornamental Apparatus.

In a pinwheel, the vanes of the pinwheel turn in the wind. As such, it is much more difficult to illuminate the vanes of a pinwheel. To electrically illuminate any object, there must be a light and a power source for that light. As such, to electrically illuminate a pinwheel, lights and a power source must be added to the pinwheel. Traditional lights require the use of batteries that are fairly heavy. Such batteries cannot be placed on the vanes of a pinwheel because the added mass would make the pinwheel too heavy to be turned by a light wind. As a consequence, batteries are not placed on the vanes. Individual lights on the vanes can be joined to a stationary common power source using wiping contacts.

However, such an assembly is very expensive to manufacture. A cheaper way to illuminate a pinwheel is to provide a stationary source of illumination that emits light towards the moving vanes. A pinwheel with a stationary internal source of illumination is shown in U.S. Pat. No. 2,857,507 to Stec, entitled Electric Lawn Ornament.

U.S. Pat. No. 5,092,809 to Kessler, entitled Pinwheel Toy, exemplifies a pinwheel that relies upon external light for illumination. However, stationary light source tend not to be as visually interesting as are moving light sources.

The problems associated with illuminating a pinwheel at multiple points are the same as those illuminating a bow at multiple points. The cost and complexity of running multiple lights to a single power source is cost prohibitive. Additionally, the room required for the single power source and the wires that must run to the single power source complicates the structure of the pinwheel. Issues of cost, balance and the weight of the vanes prevent illumination sources from being applied directly to the vanes of the pinwheel.

A need therefore exists for a low cost way to illuminate a pinwheel or bow at multiple points on the folds of these structures without detracting from their appearance or performance. This need is met by the present invention as described and claimed below.

SUMMARY OF THE INVENTION

The present invention is an illuminated assembly that can be configured as a pinwheel, pinwheel bow or decorative bow. The illuminated assembly includes segments of material that are folded over to form looped structures. Depending on the shape of the segment of material and the manner in which those segments are folded, the folded looped structures can form a pinwheel or a bow. At least one chemical light assembly is attached to the folded looped structures. The chemical light assemblies produce light when activated. The chemical light assemblies illuminate the folded loop structure, thereby adding to the appearance of the overall assembly.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
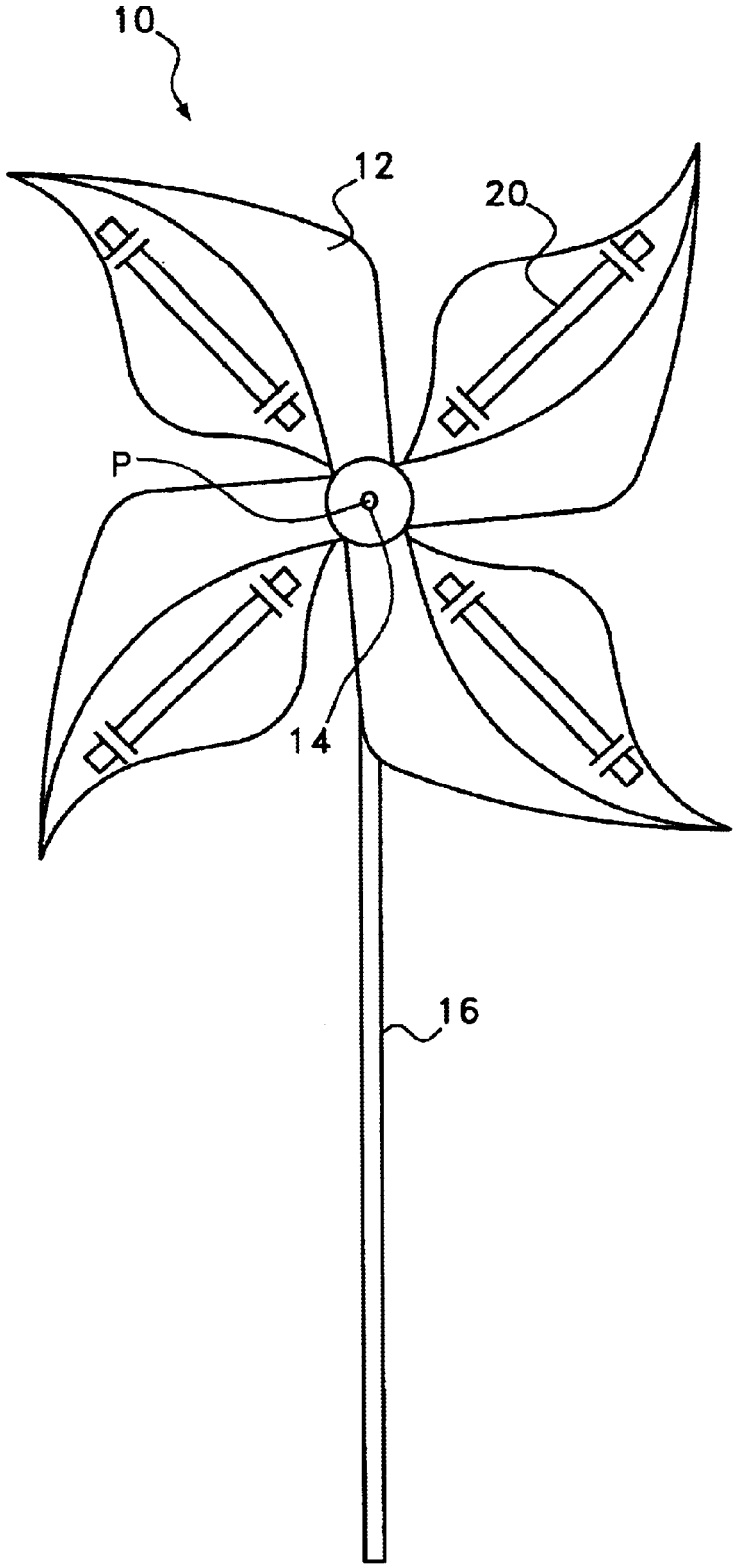
FIG. 1 is a front view of a pinwheel assembly made in accordance with the present invention.

Referring to FIG. 1, an exemplary embodiment of the present invention device is shown. The shown embodiment is that of a pinwheel 10. The pinwheel 10 contains a plurality of folded vanes 12 that radially diverge from a central point of rotation P. An axle pin 14 extends through the material of the folded vanes 12 at the central point of rotation P. The folded vanes 12 are symmetrically disposed around the axle pin 14. As such, the vanes 12 are balanced about the axle pin 14 and are free to rotate around the axle pin 14. The vanes 12 are all folded over and angled in a common direction. As such, when the folded vanes 12 catch the wind, a propeller action is created and the folded vanes 12 rotate about the axle pin 14.

The axle pin 14 engages a stick 16 behind the folded vanes 12. The stick 16 is used to support the folded vanes 12 and to help move the folded vanes 12 through the wind.

On at least some of the vanes 12 of the pinwheel 10 are located chemical illumination assemblies 20. Each of the chemical illumination assemblies 20 used on the pinwheel 10 are of the same size and weight. The chemical illumination assemblies 20 are applied symmetrically to the pinwheel 10, relative the central point of rotation P. As such, the application of the chemical illumination assemblies 20 to the vanes 12 does not effect the balance of the vanes 12 around the axle pin 14.

Figure 2:
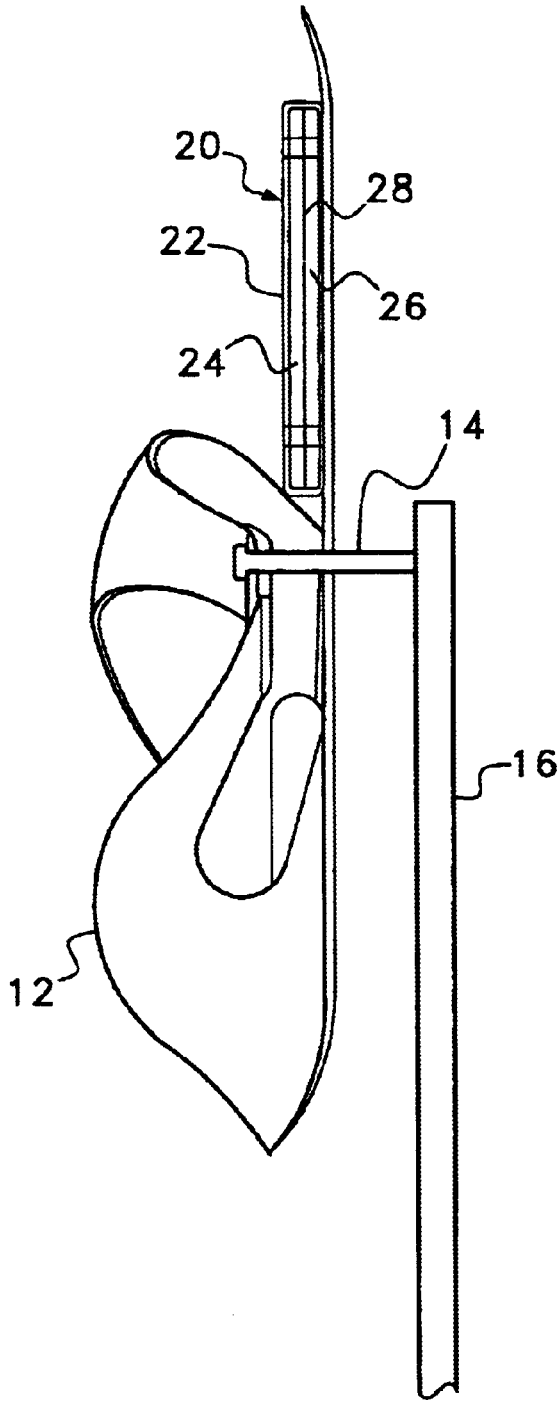
FIG. 2 is a selectively cross-sectioned view of a section of the device shown in FIG. 1.

Referring to FIG. 2, it can be seen that each chemical illumination assembly 20 is comprised of a translucent housing 22 in which two separate chemical compounds 24, 26 are stored. The two chemical compounds 24, 26 are separated from each other in the housing 22 by a breakable barrier 28. By bending the housing 22 of the chemical illumination assembly 20, the barrier 28 between the chemical compounds 24, 26 can be broken. Once broken, the two chemical compounds 24, 26 mix and a chemical reaction occurs that produces light. By varying the chemical compounds 24, 26 in the chemical illumination assembly 20, light of different colors can be produced. Typically, the light produced is green, yellow, red, blue or white. Furthermore, the chemical illumination assemblies 20 have a weight of less than one ounce each. As such, the presence of the chemical illumination assemblies 20 on the folded vanes 12 do not add significantly to the mass of the vanes 12 and therefore do not adversely effect the inertia of the pinwheel 10 and its ability to spin in the lightest of breezes. Such small chemical illumination assemblies 20 are commercially available under the trade name Cyalume(™) and are produced by American Cyanamid Company of Wayne, N.J.

The chemical illumination assemblies 20 can be attached to the vanes 12 of the pinwheel 10, either adhesively or mechanically. As is shown in FIG. 1, the chemical illumination assemblies are placed through slots cut into the material of the vanes 12. In this manner, the chemical illumination assemblies 20 can be selectively added or removed from the vanes 12 without having to reapply adhesive.

Figure 3:
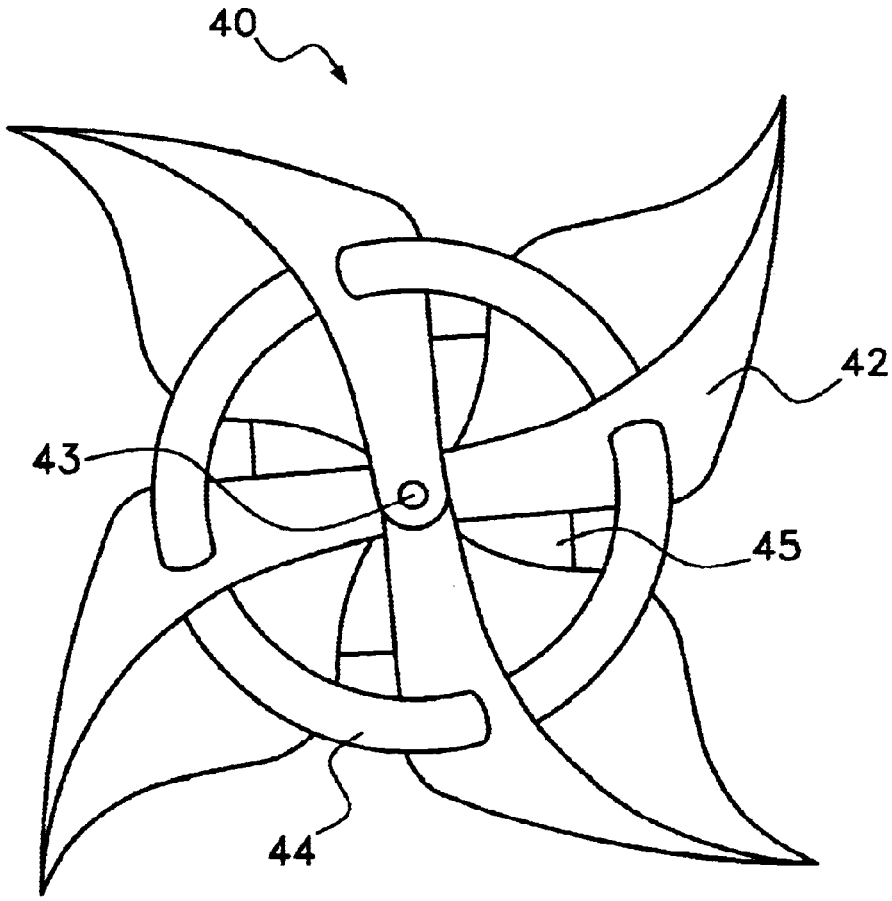
FIG. 3 is a perspective view of a pinwheel bow made in accordance with the present invention.

Referring to FIG. 3, a pinwheel bow 40 is shown. The pinwheel bow 40 has vanes 42 and a central axle 43. The central axle 43 is attached to a base 45. The base 45 has an adhesive surface that enables the base of the pinwheel bow 40 to be selectively attached to a present. Since the vanes 42 are attached to the central axle 43, the vanes 42 can rotate as a pinwheel.

The pinwheel bow 40 can have multiple chemical illumination assemblies, as were previously shown in FIG. 1. However, rather than have multiple small chemical illumination assemblies attached to the various vanes, a single elongated chemical illumination assembly 44 is strung between the various vanes 42. The single elongated chemical illumination assembly 44 is sized to complete one full circle around the vanes 42. In this manner, the presence of the chemical illumination assembly 44 does not adversely effect the balance of the vanes 42 around their central point of rotation.

To utilize the pinwheel bow 40, the vanes 42 of the pinwheel bow 40 are manually deformed before the pinwheel bow 40 is applied to a present. In this manner, the chemical illumination assembly 44 will become activated just prior to the application of the pinwheel bow 40 to a present. Once applied to the present, the rotation of the pinwheel bow 40 helps mix the chemical compounds within the chemical illumination assembly 44 and keeps the chemical illumination assembly 44 fully luminescent along its entire length.

Figure 4:
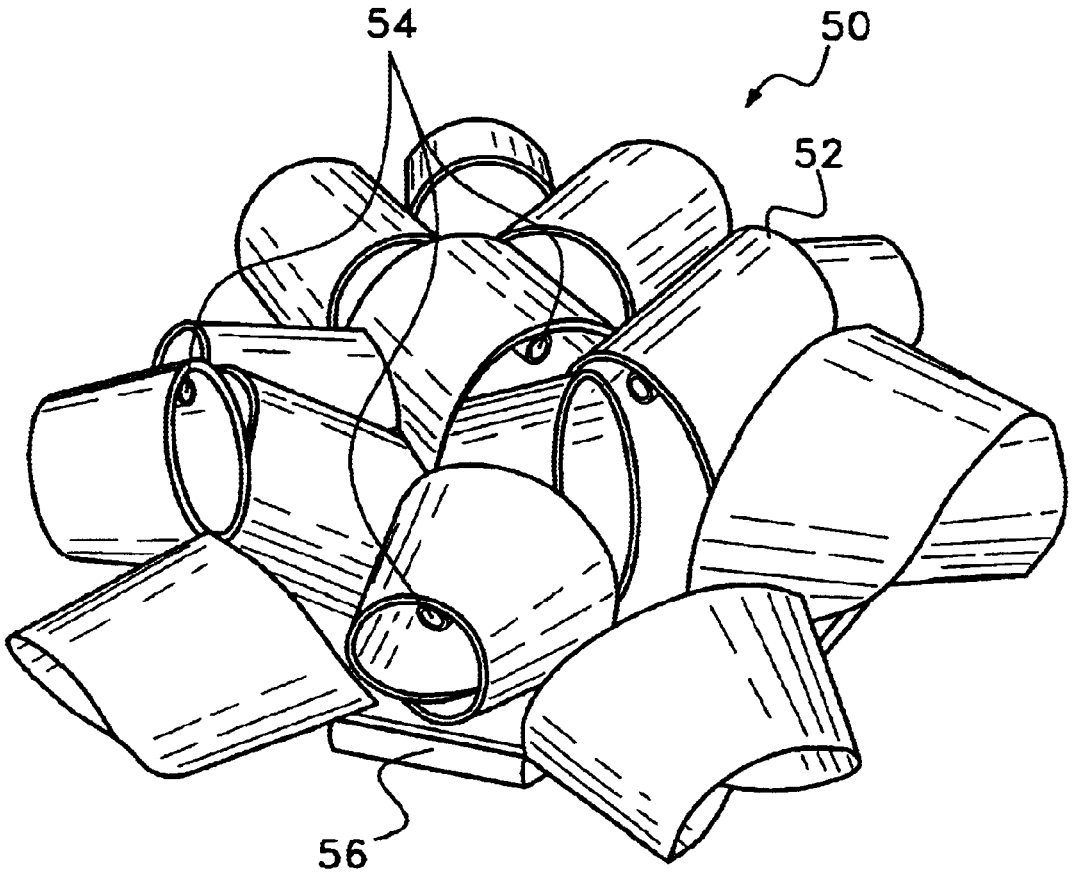
FIG. 4 is a side view of a decorative bow made in accordance with the present invention.

Referring to FIG. 4, an embodiment of the present invention is shown configured as a stationary decorative bow 50. In this embodiment, a traditional bow configuration is shown, wherein several bow loops 52 radially extend from a common point to create a bow. On at least some of the bow loops 52 are provided chemical illumination assemblies 54 of the type previously described. The chemical illumination assemblies 54 are strategically placed under some of the bow loops 52. In this manner, the chemical illumination assemblies 54 themselves are not visible, but the light emitted from the chemical illumination assemblies 54 shines inwardly on the bow loops 52 and causes the decorative bow 50 to be brightly illuminated.

It will be understood that the embodiments of the present invention device and method described and illustrated are merely exemplary and a person skilled in the art can make many variations to the shown embodiment. For example, there are many different types and styles of pinwheels, pinwheel bows and decorative bows. Any such type of style can be adapted for use with the present invention. Furthermore, the number of vanes, the number of chemical illumination assemblies and the location of the chemical illumination assemblies can be selectively altered. Chemical illumination assemblies can be located on every vane or bow loop. Alternatively, chemical illumination assemblies can be attached only to some vanes or bow loops present in a decoration. All such alternate embodiments and modifications are intended to be included within the scope of the present invention as defined below in the claims.

What is claimed is:

1. A pinwheel device, comprising:

at least one segment of material having a central area and salient points that are folded over to said central area to form a plurality of vanes that radially extend from said common central area;

at least one chemical illumination assembly disposed on at least one of said vanes that emits light when activated;

an axle pin extending through said common central area, wherein said plurality of vanes and said at least one chemical illumination assembly are free to rotate in unison around said axle pin.

2. The assembly according to claim 1, wherein said at least one chemical illumination assembly is symmetrically positioned around said common central area.

3. The assembly according to claim 1, wherein a separate chemical illumination assembly is present on at least two of said plurality of vanes.

4. The assembly according to claim 1, wherein a single chemical illumination assembly extends between at least some of said plurality of vanes.

5. The assembly according to claim 1, wherein slots are formed in at least some of said plurality of vanes and said slots are used to retain said at least one chemical illumination assembly in place on at least some of said plurality of vanes.

6. The assembly according to claim 1, further including a support shaft, wherein said axle pin extends from said support shaft.

7. The assembly according to claim 1, further including an adhesive bow base, wherein said axle pin extends from said adhesive bow base.

8. A decorative assembly, comprising:

at least one segment of material having a central point and salient points that are folded over to said central point to form loops;

at least one chemical illumination assembly disposed on at least some of said loops.

9. The assembly according to claim 8, wherein said at least one segment of material is configured as the vanes of a pinwheel.

10. The assembly according to claim 8, wherein said at least one segment of material is configured as the loops of a decorative bow.

11. The assembly according to claim 9, further including an axle pin extending through said central point, wherein said vanes and said at least one chemical illumination assembly are free to rotate in unison around said axle pin.

12. The assembly according to claim 9, wherein said at least one chemical illumination assembly is symmetrically positioned around said central point.

13. The assembly according to claim 9, wherein a separate chemical illumination assembly is present on at least two of said vanes.

14. The assembly according to claim 9, wherein a single chemical illumination assembly extends between at least some of said vanes.

15. The assembly according to claim 9, wherein slots are formed in at least some of said vanes and said slots are used to retain said at least one chemical illumination assembly in place on at least some of said vanes.

16. The assembly according to claim 11, further including a support shaft, wherein said axle pin extends from said support shaft.

17. The assembly according to claim 11, further including an adhesive bow base, wherein said axle pin extends from said adhesive bow base.

18. A pinwheel device, comprising:

a plurality of vanes radially extending from a common central area;

at least one chemical illumination assembly disposed on at least one of said vanes that emits light when activated;

an adhesive bow base;

an axle pin extending from said adhesive bow base and through said common central area, wherein said plurality of vanes and said at least one chemical illumination assembly are free to rotate in unison around said axle pin.

* * * * *